United States Patent [19]

Zeiber

[11] 3,983,580

[45] Oct. 5, 1976

[54] HAIRDO PROTECTOR

[76] Inventor: Elizabeth A. Zeiber, 318 E. 36th St., Erie, Pa. 16504

[22] Filed: Sept. 30, 1974

[21] Appl. No.: 510,247

[52] U.S. Cl. ..... 2/174; 2/202
[51] Int. Cl.[2] ..... A42B 1/00
[58] Field of Search ..... 2/205, 174, 198, 171, 2/202

[56] References Cited

UNITED STATES PATENTS

| | | | |
|---|---|---|---|
| 1,928,238 | 9/1933 | Willson et al. | 2/205 |
| 2,484,269 | 10/1949 | Carlson | 2/174 |
| 2,781,764 | 2/1957 | Miller | 2/174 X |
| 2,870,451 | 1/1959 | Brodsky | 2/202 |
| 2,988,749 | 6/1961 | Crouzet | 2/205 |
| 3,283,349 | 11/1966 | White | 2/3 R |
| 3,423,763 | 1/1969 | Schwartz | 2/205 X |
| 3,505,678 | 4/1970 | Key | 2/174 X |

FOREIGN PATENTS OR APPLICATIONS

| | | | |
|---|---|---|---|
| 398,134 | 3/1909 | France | 2/202 |
| 1,561,966 | 2/1969 | France | 2/202 |

*Primary Examiner*—Werner H. Schroeder
*Assistant Examiner*—Peter Nerbun

[57] ABSTRACT

A cover for protecting a hairdo made up of a generally cylindrical head receiving skirt portion, open at the bottom and having shoulder receiving contours formed in the lower edge of the skirt portion. A window is formed in the front of the skirt portion to provide an open space for vision of the wearer and a dome portion closes the top of the cylindrical skirt. Cords are provided for tying the skirt around the torso of the wearer, so that the wearer can remove a garment over his or her head without disturbing the hairdo.

6 Claims, 5 Drawing Figures

HAIRDO PROTECTOR

OBJECTS OF THE INVENTION

It is an object of the invention to provide an approved hair protector.

Another object of the invention is to provide a hair protector for protecting hairdos while changing clothing.

Another object of the invention is to provide a hairdo protector that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE INVENTION

Figure 4:
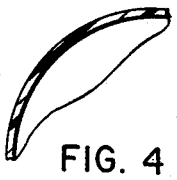
FIG. 4 is a cross sectional view taken on Line 4—4 of FIG. 2.

The invention disclosed herein is a hairdo protector for protecting a hairdo while the wearer is changing clothing that involves pulling a garment over the person's head that would ordinarily disturb the hairdo. The protector's side wall 10 is made up generally of a hollow cylindrical skirt portion open at the bottom and closed at the top. The skirt portion has a flange 19 extending outwardly from the bottom and has shoulder receiving contours 13 and 14 also having outwardly extending flanges formed in its side. The opening 15 is provided by way of a window for the person to view the surroundings and openings 20 are provided in the side walls of the window to receive cords 17 that may extend downward and may be wrapped around the torso of the wearer to hold the hairdo protector in place on the wearer's shoulders and over his or her head. The open top is closed by a generally hemispherical shaped dome 16 that provides a contour to conform generally to the top of a hairdo. It has been discovered that it is not necessary to have a hair protector that is large enough to avoid complete contact with the hairdo, even when used in connection with an extremely fluffy type of hairdo, such as an Afro type. Padding may be fixed to the inside walls on which the wearer can rest his or her head for sleep.

Various changes may be made in the size, shape and structure of the protector disclosed herein without departing from the inventive concept, which is broadly novel as set forth in the appended claims.

Figure 5:
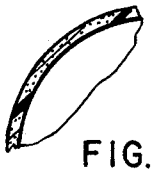
FIG. 5 is a cross sectional view similar to FIG. 4 of another embodiment of the invention.
Figure 1:
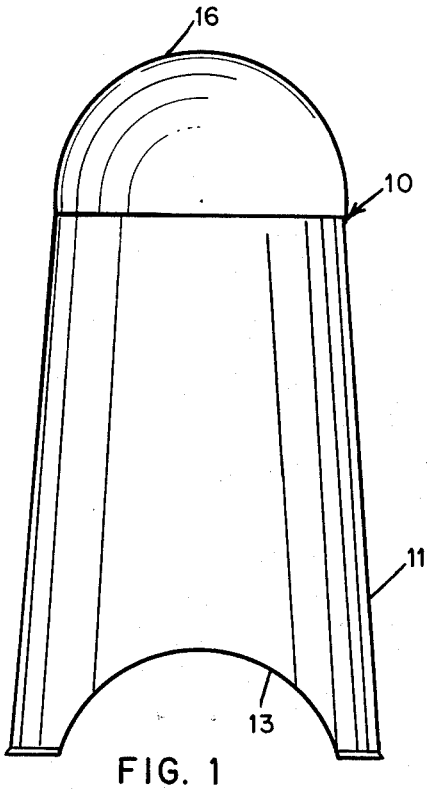
FIG. 1 is a side view of the hairdo protector according to the invention.
Figure 2:
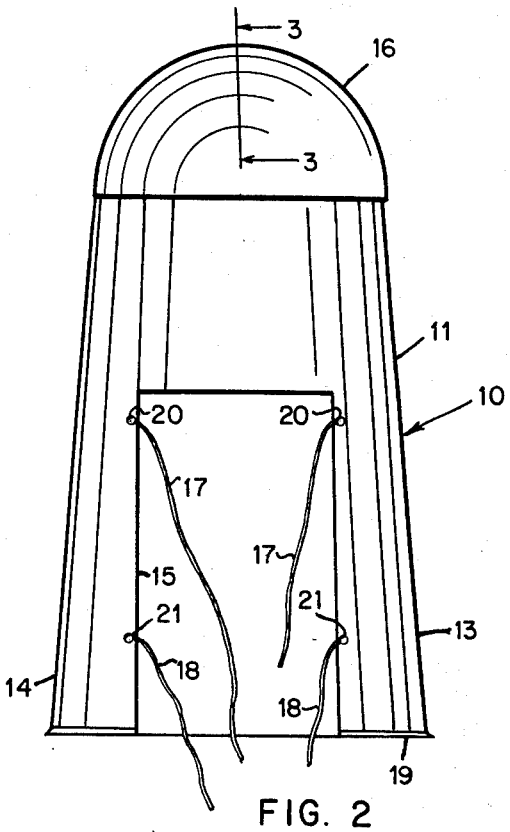
FIG. 2 is a front view of the hairdo protector.
Figure 3:
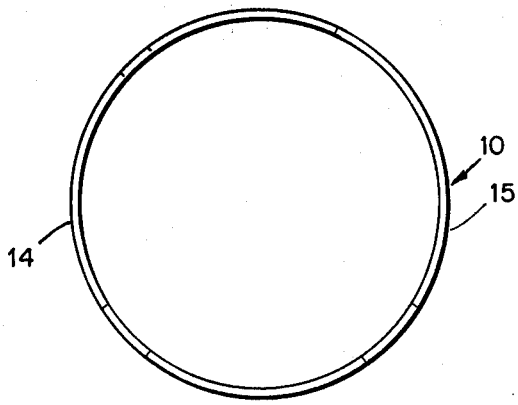
FIG. 3 is a bottom view of the hairdo protector.

The hairdo protector could be made of relatively thick foam plastic material such as urythene foam, polystyrene foam or the like. For example, FIG. 5 shows a cross sectional view of a hairdo cover made of foam plastic material.

The foregoing specification sets forth the invention in its preferred practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. A relatively light cover for ladies' hairdos made of plastic material, comprising a generally cylindrical skirt portion, a shoulder receiving contour formed at the lower edge of each side of said skirt portion, an open, generally rectangular window, providing an opening extending upwardly approximately half the height and laterally over a major portion of the width of said cover, formed in the front of said skirt portion between said contours, said window being open at its lower end and extending upward and providing an open front to said protector substantially over the entire width of the front thereof, being adapted to provide an open space for vision of the wearer, a dome portion closing the top of said cylindrical skirt portion, said skirt portion tapering upwardly and inwardly toward said dome shaped portion, said skirt portion being adapted to receive the head of a person with the hairdo, and cords attached to the sides of said window, said cords being adapted to extend about the torso of the wearer for holding the protector in place.

2. The hair protector recited in claim 1 wherein the shoulder contours have a flange extending outwardly therefrom for resting on the shoulders of a person.

3. The hairdo protector recited in claim 1 wherein said lower open end of said cylindrical portion has an outwardly directed flange affixed thereto and extending outwardly therefrom.

4. The hairdo protector recited in claim 1 wherein said dome is generally hemispherically in shape.

5. The hairdo protector recited in claim 1 wherein said foam material is a porous, open pore material.

6. The hairdo protector recited in claim 1, wherein said cylindrical skirt portion is made of foam material said foam material being approximately ¾'' thick.

* * * * *